United States Patent [19]

Burgin

[11] 4,397,231

[45] Aug. 9, 1983

[54] APPARATUS FOR PRODUCING AND COLLECTING A LIQUID EXTRACT AND A DRY BY-PRODUCT FROM A MASH

[76] Inventor: Kermit H. Burgin, R.R. 1, Box 334, Whitestown, Ind. 46075

[21] Appl. No.: 368,719

[22] Filed: Apr. 15, 1982

Related U.S. Application Data

[62] Division of Ser. No. 135,922, Mar. 31, 1980, Pat. No. 4,343,233.

[51] Int. Cl.[3] ..... B30B 9/14

[52] U.S. Cl. ..... 100/117

[58] Field of Search ..... 100/117, 145, 146, 147, 100/148, 149, 150, 904, 906; 425/DIG. 230, 208, 209; 264/118, 141

[56] References Cited

U.S. PATENT DOCUMENTS

| | | | |
|---|---|---|---|
| 2,904,827 | 9/1959 | Kaiser et al. | 264/141 |
| 2,994,105 | 8/1961 | Seal et al. | 264/118 |
| 3,048,922 | 8/1962 | Steinkemer et al. | 100/904 X |
| 3,062,657 | 11/1962 | Vollink . | |
| 3,246,594 | 4/1966 | Fisher . | |
| 3,385,235 | 5/1968 | Rickerd et al. | 425/DIG. 230 |
| 4,017,241 | 4/1977 | Papinchak et al. | 425/208 X |

*Primary Examiner*—Peter Feldman

*Attorney, Agent, or Firm*—Barnes & Thornburg

[57] ABSTRACT

An apparatus for producing and collecting a liquid extract and a pressed dry by-product from a mash of fibrous material includes an extraction chamber and a mechanism for compressing the mash of fibrous material within the extraction chamber to extract the liquid and form a pressed dry product therefrom. The extraction chamber includes a material inlet opening for filling the chamber with the mash, a liquid outlet opening for collecting the liquid extract, and a by-product outlet opening for collecting the dry by-product. The compressing mechanism expells the dry by-product from the extraction chamber once the liquid has been extracted from the mash. The mash is compressed within a movable work station, and the dry by-product is expelled from the extraction chamber by moving the work station and discharging the dry product in accordance therewith.

5 Claims, 7 Drawing Figures

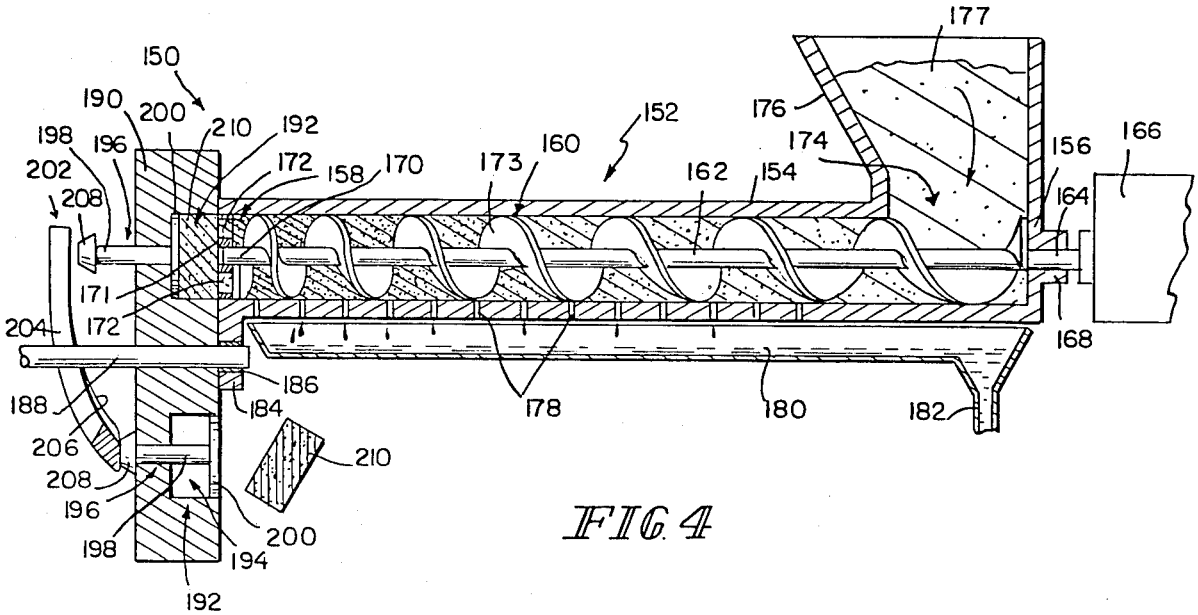
FIG. 4
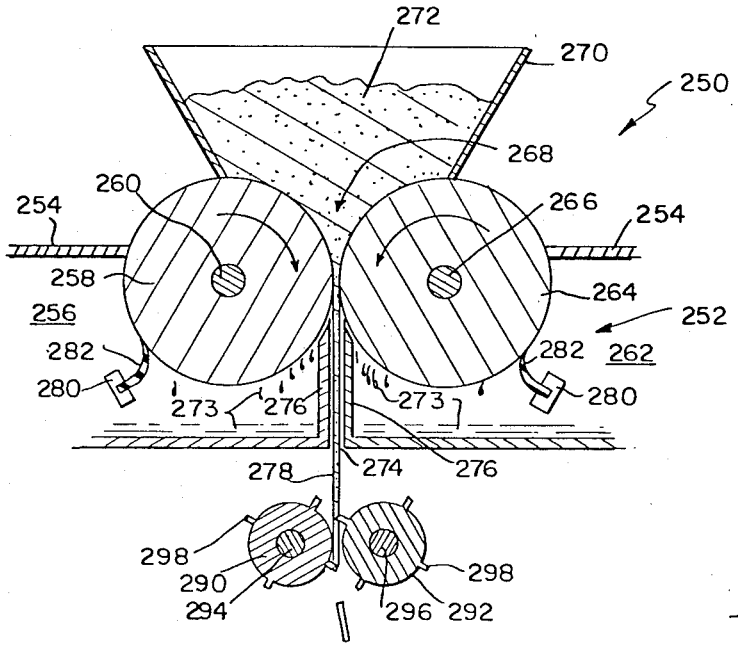
FIG. 5
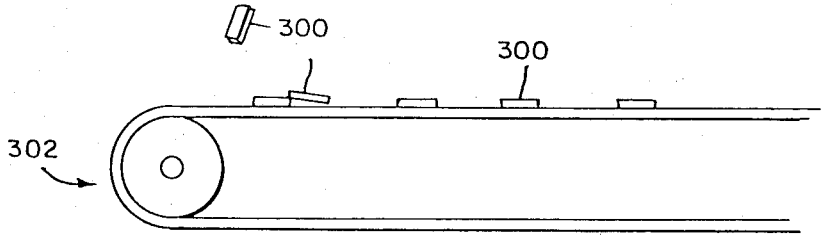

APPARATUS FOR PRODUCING AND COLLECTING A LIQUID EXTRACT AND A DRY BY-PRODUCT FROM A MASH

This is a division of application Ser. No. 135,922 filed Mar. 31, 1980, now U.S. Pat. No. 4,343,233.

The present invention relates to mechanisms and processes associated with the operation of such mechanisms for extracting a liquid from a mash. More particularly, the present invention relates to an apparatus and method of extracting and collecting a usable liquid extract and of producing and collecting a usable dry by-product from a mash of fibrous material.

There are various mechanisms presently known for producing a dry product from a moisture-filled material, such as a mash, by extracting the liquid from the material. For example, various mechanisms and processes exist for producing food products such as cereal from a mash by extracting the liquid from the mash to produce the dry food product. Most of these liquid extraction mechanisms are concerned only with retrieving or collecting the dry product since the liquid extracted from the material has no recognizable useful features.

It has long been recognized that a useful liquid such as, for example, alcohol, can be extracted from fibrous materials such as grain, wood pulp, etc., and therefore various types of mechanisms have been developed for extracting and collecting the liquid from these materials to produce alcohol. However, in the processes associated with these liquid extraction and collection mechanisms, it has been undesirable to also produce a usable dry by-product and collect such by-product.

With the increased demand for various types of fuel, and particularly liquid fuels such as alcohol, it has also become advantageous to produce and collct the dry by-product which results from the production of the liquid fuel and use of the by-product as feed for animals or some other type of fuel. Because of the lack of concern heretofore for collecting a usable liquid extract on the one hand and for collecting a usable dry by-product on the other hand when producing a dry product or liquid extract, respectively, from a mash, there presently exists a need for an apparatus and method of producing and collecting both a useful liquid extract and a useful dry by-product from a mash.

It is therefore one object of the present invention to provide an apparatus and method for producing and collecting a usable liquid extract and a usable dry by-product from a mash.

According to the present invention, the apparatus includes an extraction chamber, means for compressing the mash within the extraction chamber to extract the liquid and form a pressed dry by-product therefrom, and means for expelling the by-product from the extraction chamber. The extraction chamber includes a material inlet opening for filling the chamber with the mash, a liquid outlet opening for collecting the liquid extract, and a by-product outlet opening for collecting the expelled dry by-product.

In one illustrative embodiment of an apparatus according to the present invention, the means for compressing the mash includes two diametrically opposed fluid motors, each having a plunger which is insertable within opposite ends of the extraction chamber and movable in opposed directions within the chamber to compress the mash. The resultant pressed dry by-product is expelled from the extraction chamber by withdrawing one of the plungers from the extraction chamber and extending the other plunger to the end of the chamber, thereby discharging the by-product from the chamber.

In another illustrative embodiment of an apparatus according to the present invention, the extraction chamber includes a rotary screw conveyor for conveying the material from an inlet end of the chamber to an outlet end. Rotatably positioned in proximity to the outlet end is an index wheel including a plurality of cavities. The wheel is incrementally indexed so that each cavity is periodically positioned at the outlet end of the chamber and the mash is compressed into each cavity of the index wheel by the screw conveyor. As the wheel is further incrementally indexed, a plunger associated with each cavity is cammed to expell the pressed dry product from the cavity.

In a further illustrative embodiment of an apparatus according to the present invention, the extraction chamber includes a bifurcated housing where each section of the housing includes a rotating disk. The disks are located in close proximity to each other, and rotate in opposed directions to produce a wringer effect as the material is fed through the material inlet opening. The pressed dry by-product is therefore expelled from the extraction chamber in a continuous strip which is cut into individual briquets.

In yet another illustrative embodiment of an apparatus according to the present invention, the extraction chamber includes an index wheel including a plurality of work stations. The index wheel is horizontally positioned within the chamber, and each of the work stations includes an opening which is filled with the mash as the opening is positioned in proximity to the material inlet opening of the chamber. A first fluid motor includes a plunger for compressing the material within the opening in the index wheel and a second fluid motor includes a plunger for expelling the pressed dry product from the opening as the wheel is incrementally indexed. Accordingly, during each revolution of the index wheel, each opening is filled with mash, the mash is compressed to extract the liquid therefrom, and the pressed dry by-product is expelled.

According to the present invention, a method of producing and collecting both a liquid extract and a dry by-product from a mash of fibrous material includes the steps of loading an extraction chamber with the mash, compressing the fibrous material within a movable work station to extract the liquid and form a pressed dry by-product therefrom, collecting the liquid extract, expelling the dry by-product from the extraction chamber by moving the work station, and collecting the dry by-product.

Various other features and advantages of the present invention will become apparent in view of the following detailed description of illustrative embodiments thereof, which description should be considered in conjunction with the accompanying drawings, in which:

FIG. 4 is a diagrammatic cross-sectional view of a further embodiment of an apparatus according to the present invention for producing and collecting a liquid extract and a dry by-product;

FIG. 5 is a diagrammatic cross-sectional view of another embodiment of an apparatus according to the present invention for producing and collecting a liquid extract and a dry by-product;

Figure 1:
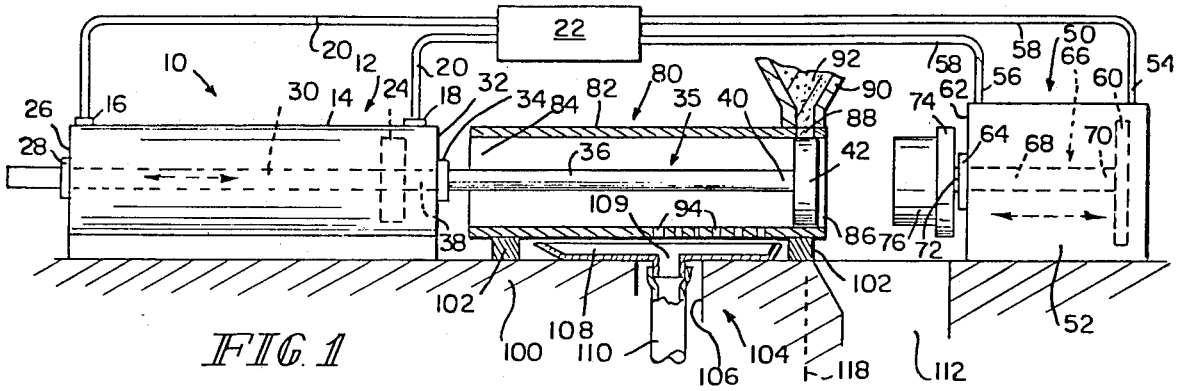
FIG. 1 is a side elevational view, partly cross-sectioned, of an apparatus according to the present invention for producing and collecting a liquid extract and a dry by-product.
Figure 2:
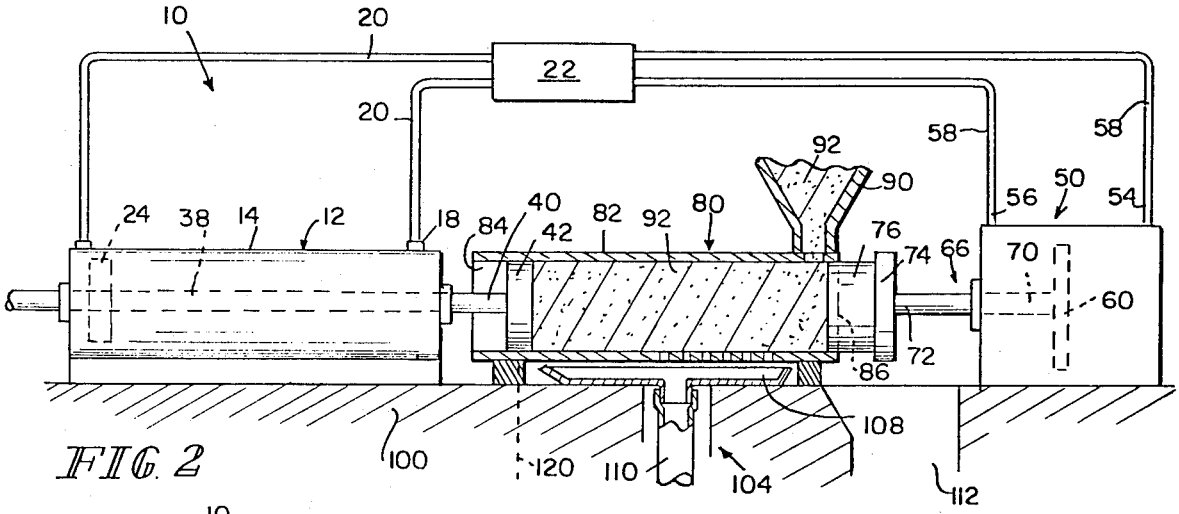
FIG. 2 is a side elevational view, partly cross-sectioned, of the apparatus of FIG. 1 illustrating a step in the process of producing and collecting a liquid extract and a dry by-product according to the present invention.
Figure 3:
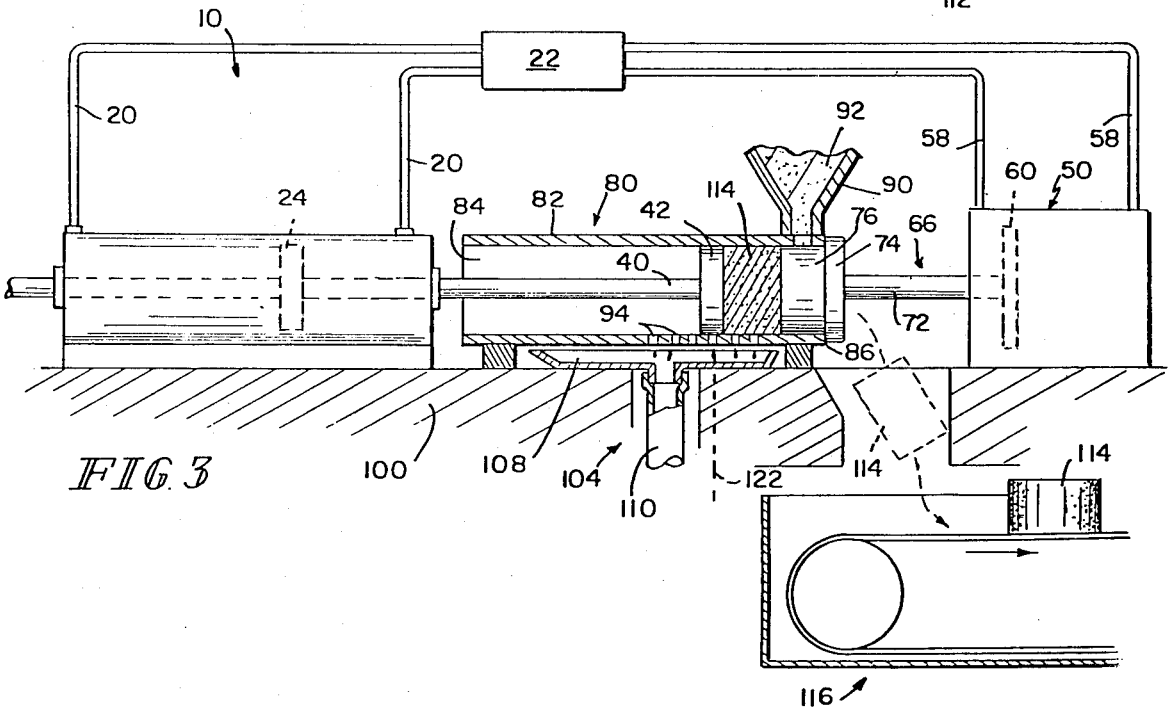
FIG. 3 is a side elevational view, partly cross-sectioned, of the apparatus of FIGS. 1 and 2, illustrating a further step in the process of producing and collecting a liquid extract and a dry by-product according to the present invention.

Referring now to the drawings and in particular to FIGS. 1–3, an apparatus 10 constructed according to the present invention produces and collects a liquid extract and a pressed dry by-product from a mash of fibrous material such as grain, wood, or other pulp. Illustratively, the liquid extract may be alcohol which is collected for use as a fuel. Furthermore, the pressed dry by-product may be a protein used for animal feed or an alternate fuel, depending upon the material comprising the mash. According to the present invention, the pressed dry by-product is formed into cakes or briquets and collected for use as either animal feed or fuel. As will be hereinafter described, the apparatus 10 produces and collects both a usable liquid extract and a usable dry by-product from a mash in a series of simple and efficient steps.

The apparatus 10 includes a first double-action fluid motor or hydraulic piston and cylinder mechanism 12. The fluid motor 12 includes an elongated cylindrical housing 14 which is closed at both of its ends, a first fluid opening 16, a second fluid opening 18, and fluid-carrying conduit 20 connecting the fluid openings 16, 18 to a fluid-control system 22. As indicated in FIGS. 1–3 by the broken line arrows, the fluid control system 22 controllably provides a fluid to the cylindrical housing 14 to axially move a piston 24 in two different directions within the cylindrical housing 14. A first end 26 of the cylindrical housing 14 includes an opening and sealing thrust bearing 28 for slidably receiving a shaft 30 which is connected to the piston 24. The opposite end 32 of the cylindrical housing 14 likewise includes an opening and sealing thrust bearing 34 for slidably receiving an elongated plunger 35. Plunger 35 includes an elongated shaft 36 which has its proximal end 38 connected to the piston 24 and its distal end 40 connected to a cylindrical head 42. It can be appreciated that in the operation of fluid motor 12 shafts 30 and 36 appear to function as a single shaft, and shaft 30 provides support for the distal end 40 of the shaft 36 when the plunger 35 is axially extended, as shown in FIG. 1. It should be noted that in FIGS. 1–3, the head 42 of the plunger 35 is moved to the left in response to movement of the piston 24 to the left and vice versa.

Continuing to refer to FIGS. 1–3, the apparatus 10 further includes a second double-action fluid motor or hydraulic piston and cylinder mechanism 50. The second fluid motor 50 includes a cylindrical closed housing 52 having a first fluid opening 54 and a second fluid opening 56 which are also connected to the fluid-control system 22 by fluid-carrying conduit 58. As can be seen in FIGS. 1–3, the cylindrical housing 52 of the second fluid motor 50 is reduced in length in comparison to the elongated cylindrical housing 14 of the first fluid motor 12. A piston 60 is axially movable within the cylindrical housing 52 in two different directions as indicated by the broken-line arrows in response to the fluid control system 22. Only one end 62 of the cylindrical housing 52 includes an opening and sealing thrust bearing 64 for slidably receiving an axially movable gate or closure 66. The gate or closure 66 includes a shaft 68 of relatively short length in comparison to the elongated shaft 36 of the plunger 35. The shaft 68 has a proximal end 70 which is connected to the piston 60 and a distal end 72 having connected thereto a cylindrical head 74 and a cylindrical plug 76. In FIGS. 1–3, the cylindrical head 74 and plug 76 are movable from left to right within the cylindrical housing 52 in response to movement of the piston 60 from left to right and vice versa. As can best be seen in the figures, the first and second fluid motors 12, 50 are positioned in parallel relationship so that the plunger 35 and the gate or closure 66 are diametrically opposed to each other and are axially movable within generally the same plane.

Interposed between the first and second fluid motors 12, 50, respectively, is an open-ended liquid extraction chamber 80 which includes an elongated cylindrical housing 82 having an inner diameter which is generally equal to the outer diameter of the cylindrical head 42 of plunger 35 and the outer diameter of the cylindrical plug 76 of the gate 66, a first open end 84, a second open end 86, a material inlet opening 88 provided in proximity to the second open end 86 of the cylindrical housing 82, a material inlet hopper 90 connected to the material inlet opening 88 for continuously feeding material through the opening 88 to fill the extraction chamber 80 with a mash 92, and a plurality of liquid extract collection openings 90 located in the extraction chamber 80 so that the liquid extract is drawn through the openings 94 by gravity.

For reasons which will become apparent in the description of the operation of the apparatus 10, the cross-sectional dimension of the material inlet opening 88 is smaller than the length of both the cylindrical head 42 of the plunger 35 and the cylindrical plug 76 of the gate 66. It should also be noted that the outer diameter of the cylindrical head 74 of the gate 66 is greater than the inner diameter of the cylindrical housing 82 of the extraction chamber 80.

As can be seen in FIGS. 1–3, the extraction chamber 80 is aligned with the plunger 35 and the gate 66 and positioned generally within the same plane as the plunger 35 and gate 66 so that the plunger 35 is insertable within the first open end 84 of the cylindrical housing 82 and the cylindrical head 42 of the plunger 35 is axially movable within the housing 82. Furthermore, the gate 66 is insertable into the second open end 86 of the housing 82 and the cylindrical plug 76 of the gate 66 is also axially movable within the housing 82. It should be noted, however, that axial movement of the cylindrical plug 76 within the housing 82 is limited by the cylindrical head 74 of the gate 66 when the cylindrical head 74 engages the second open end 86 of the housing 82.

Each of the fluid motors 12, 50 and the extraction chamber 80 are supported by a frame or base 100 to assure their proper relationship to each other for operation. While the cylindrical housings 14, 52 of the fluid motors 12, 50, respectively, may be connected directly to the frame 100, the cylindrical housing 82 of the extraction chamber 80 is elevated in spaced relationship to the frame 100 by supports 102 to allow a liquid collector 104 to be positioned between the chamber 80 and the frame 100 beneath the collection openings 94 to collect the liquid extract. The liquid collector 104 includes a collection pan or container 108 having an outlet opening 109. The frame 100 includes a first inlet opening 106 which is in direct flow communication with the liquid outlet opening 109 of the liquid collector 104 and a flexible liquid-transferring conduit or a hose 110 is connected to the liquid outlet opening 109 of the liquid collector 104 to channel the liquid extract away from the extraction chamber 80 to a storage chamber or tank (not shown). The frame 100 further includes a second inlet opening 112 provided in proximity to the second open end 86 of the extraction chamber 80 for receiving and collecting a pressed dry by-product 114 when it is expelled from the extraction chamber 80, as best illustrated in FIG. 3. A conveyor assembly 116 may be provided directly below the frame 100 in proximity to the second inlet opening 112 so that each cake of the pressed by-product 114 is carried away from the apparatus 10 for storage.

In operation, FIG. 1 illustrates the apparatus 10 in its unloaded position 118 wherein the cylindrical head 42 of the plunger 35 is axially positioned in proximity to the second open end 86 of the extraction chamber 80 so that it blocks the material inlet opening 88 and thereby prevents the mash 92 from being fed into the extraction chamber 80. The gate 66 is shown in FIG. 1 in its open position, whereby material can be expelled from the second open end 86 of the extraction chamber 80 by axial extension of the plunger 35.

Referring to FIG. 2, the apparatus 10 is shown in its loaded load position 120 wherein the cylindrical head 42 of the plunger 35 has been axially moved in proximity to the first open end 84 of the extraction chamber 80, thereby allowing the mash 92 to be fed into the extraction chamber 80 through the material inlet opening 88. The gate 66 has been axially translated from its open position as shown in FIG. 1 to its closed position as shown in FIG. 2 whereby the cylindrical plug 76 is partially inserted into the second open end 86 of the housing 82 to close the second open end 86 while keeping open the material inlet opening 88. As can therefore be seen in FIG. 2, the plunger 35 and gate 66 in cooperation with the housing 82 of chamber 80 form a closed compartment or work station which is filled through the material inlet opening 88 with the mash 92.

Referring to FIG. 3, the apparatus 10 is shown in its compression or squeezing position 122 wherein the cylindrical plug 76 of the gate 66 is projected axially into the housing 82 until the cylindrical head 74 of the gate 66 engages the second open end 86 to thereby close the material inlet opening 88 of the housing 82. The plunger 35 is projected axially into the chamber 82 to compress the mash 92, thereby extracting the liquid therefrom which passes through collection openings 94 and producing a pressed dry by-product 114. Simultaneously, the gate 66 is axially translatable from its closed position as illustrated in FIG. 2 to its open position as illustrated in FIG. 1, and the plunger 35 is further axially extended into the housing 82 to expell the pressed dry by-product 114 through the second open end 86 of the housing 82 and return to its unloaded position 118 as illustrated in FIG. 1 to close the material inlet opening 88 of the housing 82.

Important to the above-described operation of apparatus 10 is the fluid-control system 22 which must either include timing mechanisms or sensing devices to coordinate the movement of the pistons 24, 60 of the fluid motors 12, 50, respectively, so that the plunger 35 and gate 66 are operable in a desired sequence. There are various timers and/or sensing devices which are well known in the art and which may be adapted for controlling the fluid flow to fluid motors 12, 50 to control the operation of the apparatus 10 in the manner it described above, and therefore various fluid control systems 22 may be employed without departing from the scope of the present invention.

Turning now to FIG. 4, another apparatus 150 constructed according to the present invention is illustrated for producing and collecting a liquid extract and a dry by-product from a mash of fibrous material. The apparatus 150 includes a liquid extraction chamber 152. The chamber 152 includes an elongated cylindrical housing 154 having an inlet end 156 and on outlet end 158. Positioned axially within the housing 154 is a rotating worm or screw conveyor 160 for conveying the mash of fibrous material from the inlet end 156 toward the left in FIG. 4 to the outlet end 158 of the housing 154. The worm or screw conveyor 160 includes an axially extending shaft 162 having its proximal end 164 driven by a motor or gear linkage 166 to provide rotary motion and a simultaneous reciprocating motion in a direction parallel to the axis of the screw conveyor 160. An opening 168 in the outlet end 158 of housing 154 includes a journal bearing 171 for receiving the distal end 170 of shaft 162. Formed around the journal bearing 171 are a plurality of openings 172 through which the mash is pressed in response to the rotary motion of the screw conveyor 160. The screw conveyor 160 further includes a central screw feeder section 173 comprising a plurality of helical surfaces for conveying the mash from the inlet end 156 to the outlet end 158 of the housing 154.

Located in proximity to the inlet end 156 of the housing 154 is a material inlet opening 174 and a material inlet hopper 176 communicating therewith for continuously feeding a mash 177 of fibrous material into the housing 154 of the extraction chamber 152. The housing 154 also includes a plurality of liquid collection openings 178 located in the lowest point of the housing 154, and positioned directly beneath the collection openings 178 is a liquid collector pan or container 180 including a drain opening 182.

A radially, outwardly extending flange 184 is formed at the outlet end 158 of the cylindrical housing 154 and includes an aperture 186 for rotatably receiving a shaft 188. Connected to the shaft 188 for rotation therewith is an index wheel 190 including a plurality of work stations 192. Each work station 192 includes a cylindrical cavity 194 having a closed end and an open end, and having a cross-sectional diameter generally equal to the inner cross-sectional diameter of the cylindrical housing 154. As the wheel 190 is incrementally indexed by rotation of the shaft 188, each work station 192 is periodically positioned in corresponding relationship to the outlet end 158 of housing 154 so that the mash 177 of fibrous material is compressed within each cavity 194 by rotary motion of the screw conveyor 160. Accordingly, within one complete rotation of the index wheel 190, each work station 192 is positioned in a loading position corresponding to the outlet end 158 of the housing 154.

Each work station 192 also includes a plunger 196. The plunger 196 includes a shaft 198 extending through the index wheel 190 and having a cylindrical head 200 positioned in the closed end of cavity 194 of the work station 192. The cylindrical head 200 has an outer cross-sectional diameter which is generally equal to the inner cross-sectional diameter of each cylindrical cavity 194. Axial movement of the plunger 196 within the cavity 194 is accomplished by a plunger actuator mechanism 202 which includes a cam 204 having a cam surface 206. Provided on the end of the shaft 198 opposite to the cylindrical head 200 is a cam follower 208 which in response to rotation of the index wheel 190 follows the cam surface 206 to axially move the plunger 196 within the cavity 194, thereby expelling the pressed dry by-product 210 from the cavity 194. It can therefore be appreciated that with each rotation of the index wheel 190, each of the work stations 192 is also positioned in an unloading position whereby the pressed by-product 210 is expelled and collected.

It should be noted that the apparatus 150 may be operated to produce and collect a liquid extract and dry by-product without the index wheel 190. The mash 177 is progressively compressed by the rotating motion of the helical surfaces of the feeder section 173 of the conveyor 160 as it is moved toward the left in FIG. 4 to the outlet end 158 and the liquid is extracted therefrom. The index wheel 190 serves to collect and form the pressed dry by-product; however, the by-product may be expelled through the outlet end 158 by the conveyor 160 and collected in various other ways which do not require an index wheel 190 without departing from the scope of the invention.

In another illustrative embodiment shown in FIG. 5, an apparatus 250 according to the present invention for producing and collecting a liquid extract and a pressed dry by-product from a mash of fibrous material, includes a liquid extraction chamber 252. The extraction chamber 252 includes a bifurcated housing 254. The housing 254 includes a first closed section 256 having a first disk or drum 258 mounted therein for rotation. The first disk or drum 258 is rotatable about an axis 260 in a clockwise direction as indicated by the arrow in FIG. 5. The housing 254 also includes a second closed section 262 having a second disk or drum 264 mounted therein for rotation and positioned in close proximity to the first disk or drum 258. The second disk or drum 264 is rotatable about an axis 266 in a counterclockwise direction as indicated by the arrow in FIG. 5. Importantly, the separation between the first rotating disk or drum 258 and the second rotating disk or drum 264 should be kept at a minimum.

Centrally located in the housing 254 in proximity to the first and second closed sections 256, 262 is a material inlet opening 268, and a material inlet hopper 270 in communication therewith for continuously feeding a mash 272 of fibrous material into the housing 254. It can therefore be appreciated that as the mash 272 of material is fed into the housing 254, the rotating disks 258, 264 function as a wringer for pressing the mash therebetween and extracting the liquid 273 therefrom.

As the liquid 273 is extracted from the mash 272, a continuous strip of pressed dry by-product 278 is fed through a channel opening 274 formed by inturned portions 276 of the first and second sections 256, 262 of housing 254. Resilient wipers 280 are positioned in proximity to each of the rotating disks 258, 264 and each includes a flexible rubber member 282 which contacts the disks 258, 264 to remove the liquid extract from the disks 258, 264.

Positioned directly beneath and in line with the channel opening 274 are two rotating cutting disks 290, 292, one of which rotates in a clockwise direction and the other of which rotates in a counterclockwise direction about axes 294, 296, respectively. Each of the disks 290, 292 includes a plurality of equally spaced cutting members 298 which in response to the rotation of the disks 290, 292 cut the continuous strip of pressed dry by-product 278 into small briquets 300 which are then allowed to drop onto a conveyor assembly 302 and removed for storage.

Figure 6:
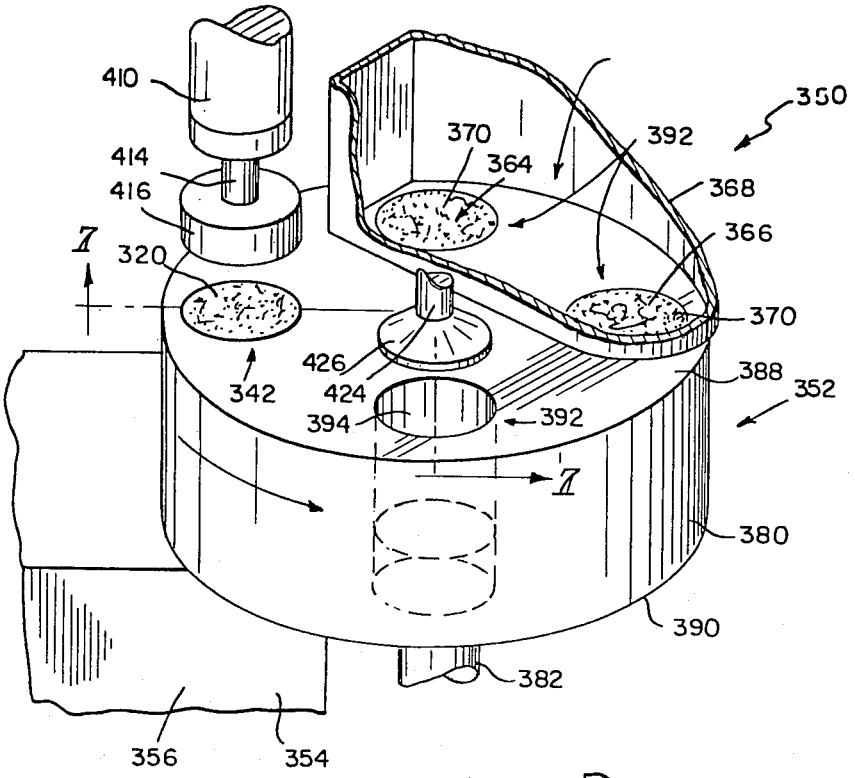
FIG. 6 is a diagrammatic perspective view, partly cross-sectioned, of another embodiment of an apparatus according to the present invention for producing and collecting a liquid extract and a dry by-product.
Figure 7:
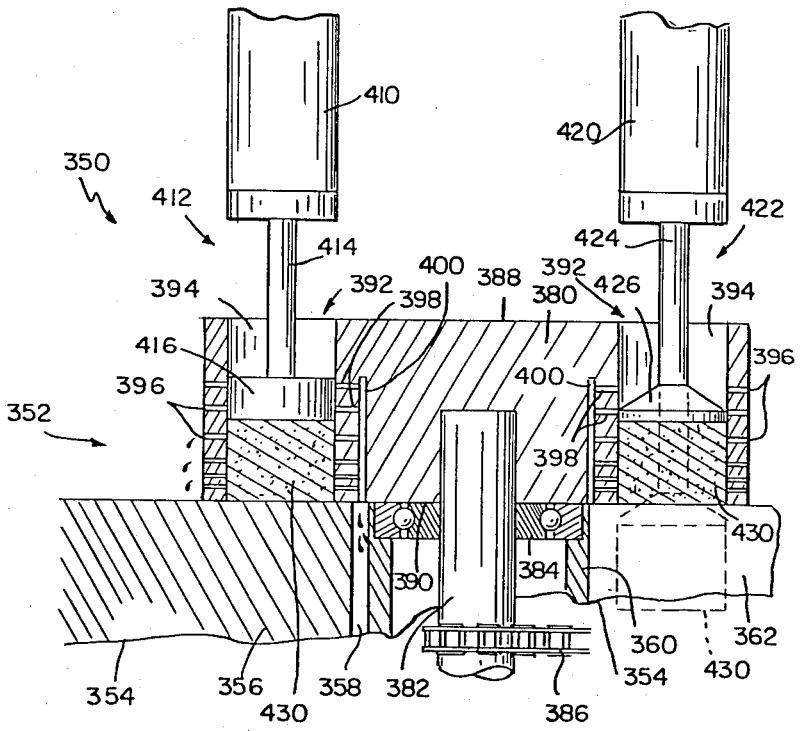
FIG. 7 is a diagrammatic cross-sectional view of the apparatus of FIG. 6 taken generally along section lines 7—7.

Referring now to FIGS. 6 and 7, another illustrative embodiment of an apparatus 350 according to the present invention is shown for producing and collecting a liquid extract and a pressed dry by-product from a mash of fibrous material. The apparatus 350 includes a liquid extraction chamber 252. The extraction chamber 252 includes a bifurcated housing 354. The housing 354 includes a first housing section 356 having a liquid collection opening 358 and a second housing section 360 having a pressed dry by-product collection opening 362. The housing 354 includes two material inlet openings 364, 366 and a material inlet hopper 368 in communication with each of the material inlet openings 364, 366 for continuously feeding a mash 370 of fibrous material into the extraction chamber 352.

Horizontally positioned within the extraction chamber 352 and interposed between the housing sections 356, 360 and the material inlet openings 364, 366 is a cylindrical index wheel 380 which is rotatable upon a shaft 382. The shaft 382 is positioned between the first and second housing sections 356, 360 and held in position for rotation by a journal bearing 384. Connected to the shaft 382 is an indexing apparatus 386 for incrementally indexing the wheel 380. The index wheel 380 includes a top surface 388 which is located in proximity to the material inlet openings 364, 366 and a bottom surface 390 which is located in proximity to the first and second housing sections 356, 360, respectively, and the liquid collection opening 358 and the dry by-product collection opening 362, respectively.

The index wheel 380 includes a plurality of work stations 392 and each work station 392 includes a cylindrical bore 394 formed axially through the wheel 380. Each of the bores 394 includes a plurality of liquid collection openings 396 projecting radially outward in the wheel 380 from the bore 394. The liquid collection openings within each bore 394 are progressively spaced closer together in proximity to the bottom surface 390 of the wheel 380. Each of the bores 394 also includes a plurality of liquid collection openings 398 projecting radially inward in the wheel 380 from the bore 394 which are also progressively spaced closer together in proximity to the bottom surface 390 of the wheel 380. Communicating with each of the radially inward projecting liquid collection openings 398 is an axially extending liquid collection slot 400 opening through the bottom surface 390 of the index wheel 380 in fluid communication with the liquid collection opening 358 in the first housing section 356 when each work station 392 is moved into its compression position.

The apparatus 350 further includes a first fluid motor or hydraulic piston and cylinder mechanism 410 which includes a first plunger 412 which is extended axially relative to the index wheel 380 and is located so as to correspond in position to each bore 394 of a work station 392 as the wheel 380 is indexed. The first plunger 412 includes a shaft 414 and a cylindrical head 416 connected thereto. The cylindrical head 416 has an outer cross-sectional diameter which is generally equal to the inner cross-sectional diameter of each of the cylindrical bores 394 so that the first plunger 412 is axially movable within each of the cylindrical bores 394 when it is positioned beneath the first plunger 412. The first plunger 412 is axially moved into each bore 394 to compress the mash 370 of fibrous material against the first housing section 356 to extract the liquid therefrom. The first plunger 412 is then removed from the bore 394 and the wheel 380 is indexed so that the bore 394 is then located in its unloading position, as best illustrated in FIG. 7.

In the unloading position of each of the bores 394, the apparatus 350 further includes a second fluid motor or hydraulic piston and cylinder mechanism 420 which includes a second plunger 422 located for axial movement within each of the bores 394 as they are moved into the unloading position. The second plunger 422 includes a shaft 424 having a generally cylindrical head 426. The outer cross-sectional diameter of the head 426 is generally equal to the inner cross-sectional diameter of each of the bores 394 so that the second plunger 422 is axially movable within each of the bores 394 as they are indexed to the unloading position to expel the pressed dry by-product 430 from the bore 394 into the dry by-product collection opening 362 in the second housing section 360. Accordingly, as the wheel 380 is rotatably indexed, each work station 392 is moved first to a loading position in proximity to either one of the material inlet openings 364, 366, is thereafter moved to a liquid extraction or compression position corresponding to the first plunger 412, and is finally moved to an unloading position corresponding to the second plunger 422 where the pressed dry by-product 430 is expelled from the work station 392 so that the work station 392 may again complete the cycle of loading, compressing, and unloading.

While various illustrative embodiments of the present invention have been described and shown in FIGS. 1–7, it can be appreciated that other apparatus may be employed for performing the method of the present invention of producing and collecting a liquid extract and a pressed dry by-product from a mash of fibrous material without departing from the scope of the invention.

What is claimed is:

1. An apparatus for producing and collecting a liquid extract and a dry by-product from a mash of material, comprising: an extraction chamber having a closed end and an open end, the chamber including a material inlet opening located in proximity to the closed end for filling the chamber with the mash, a liquid outlet opening for collecting the liquid extract, a by-product outlet opening at the open end for collecting the dry by-product, a screw conveyor axially positioned within the chamber to move the material from the filler opening to the open end, means for rotating the screw conveyor about its axis to compress the mash and extract the liquid therefrom, an index wheel, means for rotatably mounting the wheel to the chamber in proximity to the open end, the rotatable mounting means having an axis parallel to the axis of the rotation of the screw conveyor, means for incrementally rotating the index wheel, the index wheel including a plurality of work stations provided in proximity to the periphery thereof which are periodically presented at the open end in response to rotation of the wheel, the screw conveyor compressing the mash into each work station when presented at the open end to extract the liquid therefrom, and means for expelling the by-product from each work station of the wheel.

2. The apparatus as recited in claim 1 wherein each work station of the index wheel includes a concavity opening in the direction of the by-product outlet opening of the chamber and the expelling means includes a plunger axially movable within the concavity.

3. The apparatus as recited in claim 2 wherein each plunger associated with a concavity includes a head located within the concavity and connected to a push rod extending axially through the wheel.

4. The apparatus as recited in claim 3, wherein the expelling means further includes a plunger-actuator mechanism including a cam surface, each push rod periodically engages and follows the cam surface when the wheel is rotated to axially move the head of the plunger within the concavity and expel the dry by-product.

5. An apparatus for producing and collecting a liquid extract and a dry by-product from a mash of material, comprising: an extraction chamber, the chamber including a material inlet opening for filling the chamber with the mash and a liquid outlet opening for collecting the liquid extract, means for compressing the mash within the extraction chamber to extract the liquid and form a pressed dry by-product therefrom, a by-product outlet opening, the compressing means including a screw conveyor axially positioned within the extraction chamber, means for rotating the screw conveyor to move fibrous material from the filler opening toward the by-product outlet opening of the extraction chamber, an index wheel, means for rotatably mounting the wheel to the extraction chamber in proximity to the by-product outlet opening to collect the dry by-product, the index wheel including a plurality of work stations, each work station of the index wheel including a concavity opening toward the by-product outlet opening of the chamber, the wheel including a cycle of rotation during which each concavity is positioned in corresponding relationship to the by-product outlet opening of the chamber and the mash is compressed into the concavity by rotation of the screw conveyor within the chamber, and means for expelling the by-product from the index wheel, the expelling means including a plunger axially movable within each concavity, each plunger including a head located within the concavity, a push rod connected to each head and extending axially into the concavity, each push rod providing a cam follower, and plunger actuator means for moving the plunger to expell the compressed by-product, the plunger actuator means including a cam surface, the cam follower of each push rod engaging and following the cam surface when the wheel is rotated to axially move the head of the plunger within the concavity and expel the dry by-product.

* * * * *